United States Patent [19]

Bate

[11] Patent Number: 4,949,533

[45] Date of Patent: Aug. 21, 1990

[54] PACKAGING MACHINE AND PROCESS

[75] Inventor: Frederick D. C. Bate, Nelson, United Kingdom

[73] Assignee: Elmwood Packing Machinery Limited, Colen, United Kingdom

[21] Appl. No.: 151,775

[22] Filed: Feb. 3, 1988

[30] Foreign Application Priority Data

Feb. 4, 1987 [GB] United Kingdom ..... 8702486

[51] Int. Cl.[5] ..... B65B 11/02

[52] U.S. Cl. ..... 53/556; 53/588

[58] Field of Search ..... 53/556, 587, 588, 211, 53/210

[56] References Cited

U.S. PATENT DOCUMENTS

| | | | |
|---|---|---|---|
| 3,863,425 | 2/1975 | Edwards | 53/211 |
| 4,109,445 | 8/1978 | Shulman | 53/588 X |
| 4,248,031 | 2/1981 | Del Pozo | 53/587 X |
| 4,283,903 | 8/1981 | Mayhall | 53/587 |
| 4,429,514 | 2/1984 | Lancaster | 53/556 |
| 4,620,408 | 11/1986 | Parnes | 53/556 X |
| 4,658,570 | 4/1987 | Thomas | 53/556 |
| 4,712,354 | 12/1987 | Lancaster | 53/588 X |

*Primary Examiner*—John Sipos

*Attorney, Agent, or Firm*—Workman, Nydegger & Jensen

[57] ABSTRACT

A machine for band wrapping articles characterized in that it comprises a rotatable support for a supply of wrapping material which preferably is a hydrophobic film of resiliently stretchable plastics material, an adjustable support for the article to be wrapped, the adjustable support comprising two or more support members movable relative to each other, means enabling the wrapping material to be wrapped round both the support members and the article and the means enabling the material during its travel from the supply to the article (i) to be maintained under tension and (ii) to be reciprocated at right angles to the direction of travel of the material during the wrapping operation the support members being adapted to be removed from between the wrapping material and the article. Preferred members are smooth flat plates or blades the surface of which has been treated with an anti-friction agent, for example, polytetrafluoroethylene.

8 Claims, 2 Drawing Sheets

PACKAGING MACHINE AND PROCESS

BACKGROUND

1. The Field of the Invention

This invention relates to an improvement in machines for band wrapping of articles.

2. Technical Background

Band wrapping of articles is widely practiced and involves assembling a group of individual articles on a support and then winding flexible sheet material obtained from a roll round the assembly so that it can be handled as a single entity. The assembly is generally of rectangular shape and comprises a number of rectangular articles or articles of other shapes which can nevertheless be arranged into a rectangular or other regular shaped assembly. The latter can be either single or double wrapped. In the former case, the assembly will have both its top and bottom covered and also one pair of opposing sides.

When single wrapping is employed, it is customary to allow the wrapping material covering opposing sides just to extend round the ends of the assembly so as to cover a small part of the otherwise unwrapped sides. In this way some additional containment of the assembly can be achieved. When the assembly is wrapped on all four sides, it is said to be double wrapped. During the unwinding of wrapping material from the roll the material tends to stretch and its width to diminish or "neck".

A considerable variety of fibrous and filmic sheet materials have been used for band wrapping although those that are employed most extensively are flexible sheets of different forms of synthetic plastics materials which have varying degrees of stretchability when subjected to tension.

A material which has been developed recently known as "one side cling stretch film" is of especial use for wrapping purposes. This material is highly stretchable synthetic plastics material which has mildly pressure sensitive adhesive qualities on one side and little or no such properties on the reverse side. Consequently, very satisfactory packages can be used with this material because overlapping bands of the surrounding articles cling to one another and thereby improve the integrity of the wrapping. At the same time, if two packages came into contact, they do not adhere to one another or to other surfaces, for example, the surfaces of mechanical handling conveyors.

One of the problems encountered in band wrapping with existing machines stems from the fact that the sizes of different assemblies to be wrapped can vary greatly. On the other hand, band wrapping has to be carried out in a precise way if satisfactory packages are to be obtained.

Consequently, in order to meet all likely requirements, either the supplier or the user of the wrapping material has to retain in stock a considerable number of rolls of material of different widths. This is both costly and inconvenient. The present invention provides a machine which is directed to overcoming this problem as well as making available other advantages.

BRIEF SUMMARY AND OBJECTS OF THE INVENTION

This invention provides a machine for band wrapping an article comprising a rotatable support for a supply of wrapping material, an adjustable support for the article to be wrapped the adjustable support comprising two or more support members movable relative to each other, means enabling the wrapping material to be wrapped round both the article and the support members, and means enabling the material during its travel from the supply to the article (i) to be maintained under tension and (ii) to be made to undergo reciprocatory motion in a direction at right angles to its direction of travel, the support members being adapted to be removed from between the wrapping material and the article.

BRIEF DESCRIPTION OF THE DRAWINGS

This invention is illustrated but not restricted by the following drawings in which.

DETAILED DESCRIPTION OF THE PREFERRED EMBODIMENTS

Figure 1:
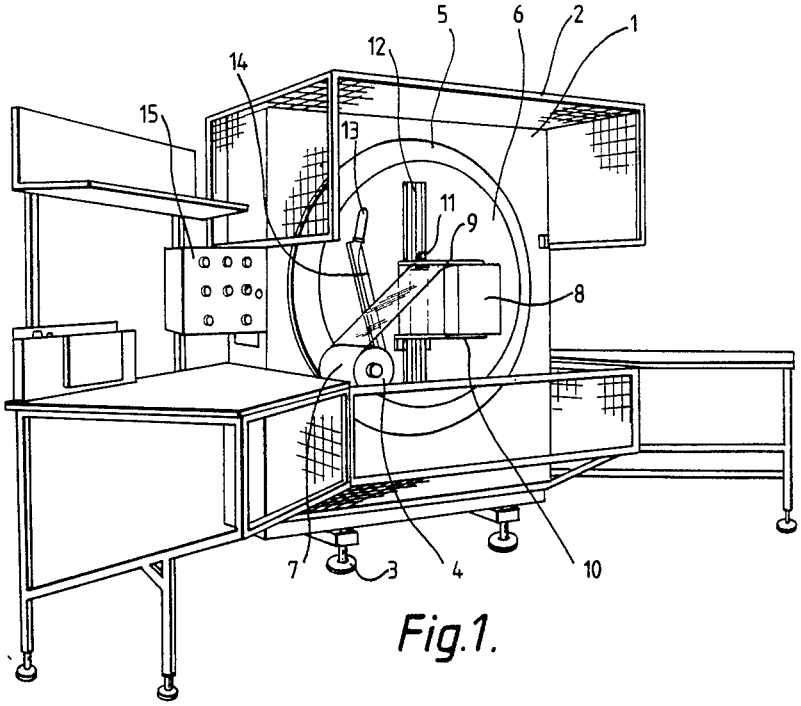
FIG. 1 is an angled view taken in perspective of one preferred form of invention machine.
Figure 2:
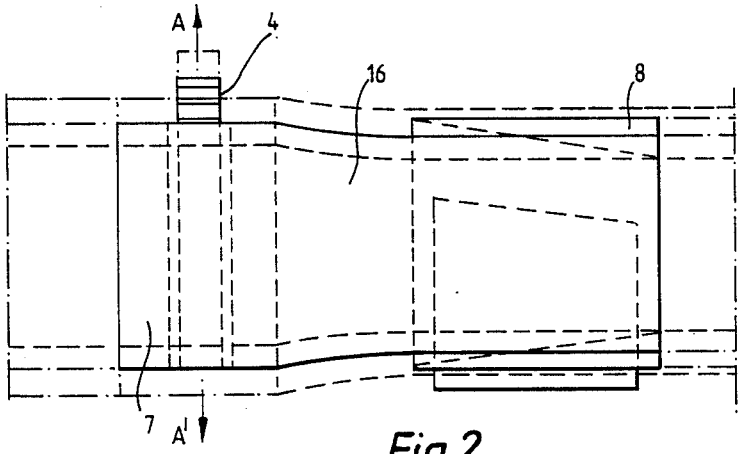
FIG. 2 is a view taken in plan showing schematically one aspect of the operation of the machine illustrated in FIG. 1.

In the above figures, a machine shown generally as 1 is provided with a safety guard 2 and leveling feet 3. A mandrel 4 is secured rotatably to a driven carrier wheel 5 located behind a stationary support wall 6. The mandrel 4 is provided with a braking device (not shown) which tensions the film and means enabling the mandrel to move with reciprocal motion in a coaxial direction along line AA at right angles to the driven carrier wheel 5.

A roll 7 of "one side cling stretch film" is fixed to the mandrel and a sheet of the film passes under tension round an assembly of articles 8 which are held firmly together between blades 9 and 10. Other kinds of wrapping materials can be used for example paper. However, plastics films and especially those which are resiliently stretchable are preferred.

The extent of reciprocation of the mandrel which is required depends upon the relative widths of the article to be packaged and the width of wrapping material being supplied from the roll. If, on one hand, the amount of reciprocation is too low, there will be excessive overlapping of, and consequent wastage of, the material. On the other hand, if the extent is too high, gaps will be formed between the convolutions and in certain circumstances this might be undesirable.

For most forms of packages the extent of reciprocation is arranged preferably to be between 20 and 40 percent of the width of the article to be packaged, the width being measured along an axis passing through the article at right angles to the support wall 6.

In general, a single roll of material is mounted on the mandrel. However, for certain packaging operations two or more rolls of the same or different width can be used simultaneously. When more than one roll is employed, they s 2 can be mounted onto the mandrel in contact with one another.

However, if desired, adjacent rolls can be kept separate by spacing members which can take the form of short cylindrical sleeves which are slid onto the mandrel. In this way the use of more than one roll of material enables a roll of standard width to be used to wrap articles having a wider range of dimensions.

The tension in the material caused by the braking action applied to mandrel 4 results in necking 16. Tension in the film can be created in other ways. For example, as material unwinds from roll 7 it can be made to bear against an adjustable idler roller (not shown) carried by an arm fixed to the carrier wheel 5.

The blades are connected to adjustable supports 11 which can slide between and be locked to rails 12. This arrangement enables the space between blades 9 and 10 to be varied to accommodate different sizes or numbers of packages. Furthermore, the blades act in the manner of the jaws of a vice and ensure that the assembly of articles does not move during the packaging operation. The operation of the machine is controlled by a programmer 15.

During the operation of the machine strips of wrapping material become wound round not only the articles but also the blades which in general are separated from the package end of the wrapping operation. This can be achieved readily by drawing the assembly off the blades manually. However, in certain instances at least one of the blades, and in the present case the upper blade, can be removed when the articles have been secured together by one or two windings of the material. The removal of the top blade or blades in this way is especially useful in the wrapping of bundles of newspapers. In such instances subsequent windings of film are applied directly to the top of the bundle.

In order to enable the blades to be removed and for the wrapping material to continue to hold the boxes firmly together, the blades are preferably as thin as practicable, commensurate with being sufficiently strong to provide sufficient support. Furthermore, the surfaces of the blades should be smooth and treated preferably with a polytetrafluoroethylene polymer or other anti-friction agent.

The support wall 6 also has connected to it a film cutting device consisting of a lever 13 retained removably in a socket towards its upper end to the support wall 6 and connected for pivotal action towards its lower end. The lever incorporates a cutting wire 14 which can be heated with electricity when required by a switch (not shown) connected operably to the lever 13. The operation of the machine is controlled electronically by a programmer 15.

In operation, blades 9 and 10 are separated sufficiently to receive an assembly of articles to be single wrapped. The articles are then placed on lower blade 10 and upper blade 9 is lowered until it presses onto the assembly of articles. Both blades are then locked into position. Material is then withdrawn manually from roll 7 and made to engage with the assembly.

The programmer 15 is then fed with data to enable it to determine the frequency and magnitude of reciprocations required to be performed by the mandrel, the speed of rotation of wheel 5 and the amount of braking to be applied to mandrel 4 so as to ensure that during operation of the machine sufficient drag is imposed on the material to ensure about 50 percent necking although the extent of necking is likely to vary with other wrapping materials.

On switching on the machine, carrier wheel 5 rotates in an anticlockwise direction carrying with it the roll of material 7, which with the support mandrel reciprocates at right angles to wheel 5.

When the single wrapping has been completed, the mandrel together with roll is allowed to return to its original position of rest after which cutting lever 13 is pulled from its retaining socket and pivoted outwards and downwards. During this process a switch (not shown) is closed causing a current of electricity to flow through cutting wire 14 which becomes heated. As the lever continues its downward movement the wire is drawn through the material which becomes severed. The package is then removed from between the plates which, although sandwiched between the wrapping material and the articles, can nevertheless be removed readily.

One of the advantages of the present machine lies in the different ways that it can be operated so as to enable not only packages of different sizes and shapes to be produced but also in the variation in the wrapping which can be introduced within any given package. Thus, by supply of appropriate information to the programmer, not only can the extent of overlap of adjacent windings of the wrapping material be varied but in addition, if desired, overlap can be prevented thus causing gaps to be formed between the windings.

On the other hand, if the width of the wrapping material is equal to or greater than the width of the article, the latter can be wrapped without utilizing the reciprocating facility.

A further advantage of the machine resides in the fact that the wrapping material can be applied in the form of diagonally disposed windings and as a result packages can be formed which are stronger than those which have been band wrapped in a conventional way. The versatility of the machine stems very largely from accurate control which is obtainable over the degree of necking, the magnitude and frequency of reciprocation of the material in its travel to the article to be packaged.

In the above machine the mandrel, together with the roll of wrapping material, is made to reciprocate at right angles to the direction of travel of the film. However, the film can be made to reciprocate in other ways.

For example, the movement of the mandrel 4 can be confined to rotary action in which the blades together with the assembly of articles can be made to reciprocate. A further possibility is for both the mandrel and the plates being made to rock backwards and forwards with a motion having a component acting at right angles to the direction of travel of the material. In general, reciprocation of the mandrel is preferred.

Figure 3:
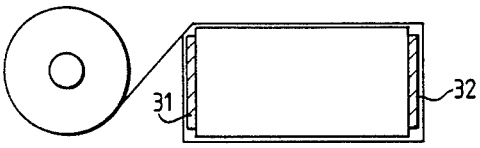
FIGS. 3 to 7 inclusive are views taken in vertical section of other forms of support members.

The support members can take various forms provided that they are sufficiently smooth and free from protuberances so as to enable them to be separated from between the windings of wrapping material and the articles which have been wrapped. Thus, they can be flat blades or plates as illustrated in FIG. 1 or in the form of flattened tines of a fork. The support can be located above and below the article. However, as shown in FIG. 3, the support members (31 and 32) can be located on either side of the article.

Figure 4:
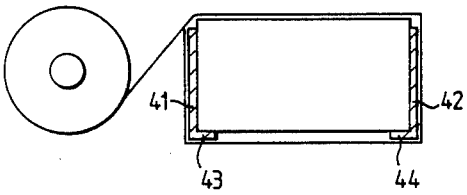
Figure 5:
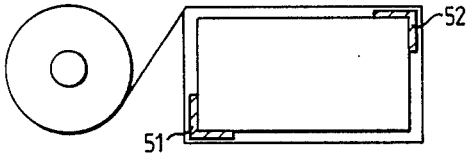
Figure 6:
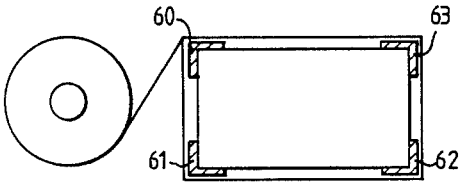

In certain cases the supports can with advantage incorporate a blade with an edge piece 41 and 42 as shown in FIG. 4. Further variants comprise the use of two or four edge supports 51, 52 and 61 to 64 as shown in FIGS. 5 and 6.

Figure 7:
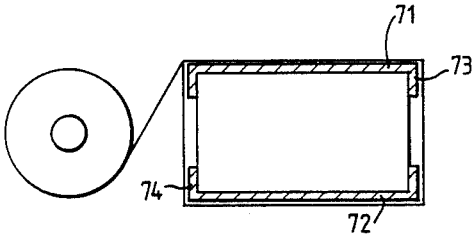

FIG. 7 shows the use of a combination of top and bottom blades 71 and 72 and edges 73 and 74. The support members can be secured slidably to the adjustable support so that distance between the members can be varied to accommodate articles of different sizes. Alternatively, they can be fixed removably into holes or slots formed into the adjustable support.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. patent is:

1. An apparatus for band wrapping an article comprising:

a rotatable support for a supply of wrapping material;

an adjustable support for the article to be wrapped thereby permitting a variety of differently sized articles to be band wrapped by a single apparatus, the adjustable support having two or more support members movable relative to each other, wherein the surfaces of the support members have been treated with a friction reducing agent;

means enabling the wrapping material to be wrapped round both the article and the support members, the support members being adapted to be removed from between the wrapping material and the article;

means for maintaining the wrapping material under tension during its travel from the supply to the article; and means for reciprocating the rotatable support an amount in the range from about twenty to about forty percent of the width of the article being wrapped in a substantially horizontal direction parallel to the axis of rotation of said rotatable support, such that the wrapping material, during its travel from the supply to the article, undergoes reciprocatory motion in a direction perpendicular to its direction of travel and the distance of travel of the wrapping material is limited to a distance substantially less than the width of the article being wrapped.

2. An apparatus for band wrapping an article as defined in claim 1 wherein the rotatable support is a mandrel.

3. An apparatus for band wrapping an article as defined in claim 1 wherein the supply of wrapping material is a stretchable plastic sheet material.

4. An apparatus for band wrapping an article as defined in claim 5 wherein the sheet material has a width smaller than the width of the article.

5. An apparatus for band wrapping an article as defined in claim 1 wherein means enabling the material during its travel from the supply to the article being maintained under tension is a brake incorporated with the mandrel.

6. An apparatus for band wrapping an article as defined in claim 1 wherein the friction reducing agent comprises tetrafluoroethylene polymer.

7. An apparatus for band wrapping an article comprising:

a rotatable support for a supply of stretchable plastic wrapping material having a width smaller than the width of the article;

an adjustable support for the article to be wrapped thereby permitting a variety of differently sized articles to be band wrapped by a single apparatus, the adjustable support having two or more support members movable relative to each other, wherein the surfaces of the support members have been treated with a friction reducing agent, said adjustable support being configured to hold the article substantially stationary while being wrapped;

means enabling the wrapping material to be wrapped round both the article and the support members, the support members being adapted to be removed from between the wrapping material and the article;

means for maintaining the wrapping material under tension during its travel from the supply to the article; and means for reciprocating the rotatable support an amount from about twenty percent to about forty percent of the width of the article being wrapped and in a substantially horizontal direction parallel to the axis of rotation of said rotatable support, such that the wrapping material, during its travel from the supply to the article, undergoes reciprocatory motion in a direction perpendicular to its direction of travel and the distance of travel of the wrapping material is limited to a distance substantially less than the width of the article being wrapped.

8. An apparatus for band wrapping an article as defined in claim 1 wherein the adjustable support is configured to hold the article to be wrapped substantially stationary while being wrapped.

* * * * *

UNITED STATES PATENT AND TRADEMARK OFFICE

CERTIFICATE OF CORRECTION

PATENT NO. : 4,949,533

DATED : August 21, 1990

INVENTOR(S) : FREDERICK D.C. BATE

It is certified that error appears in the above-identified patent and that said Letters Patent is hereby corrected as shown below:

Column 2, line 59, delete "s 2"

Signed and Sealed this

Fourth Day of August, 1992

*Attest:*

DOUGLAS B. COMER

*Attesting Officer*

*Acting Commissioner of Patents and Trademarks*